US007066763B1

(12) United States Patent
Corwin et al.

(10) Patent No.: US 7,066,763 B1
(45) Date of Patent: Jun. 27, 2006

(54) JUNCTION BOX ASSEMBLY WITH CAM LEVERS

(75) Inventors: Sarah Corwin, Wyandotte, MI (US); Bennie Malcom, Detroit, MI (US); Nathan Like, Westland, MI (US)

(73) Assignee: Sumitomo Wiring Systems, Ltd., Mie (JP)

( * ) Notice: Subject to any disclaimer, the term of this patent is extended or adjusted under 35 U.S.C. 154(b) by 0 days.

(21) Appl. No.: 11/130,209

(22) Filed: May 17, 2005

(51) Int. Cl.
*H01R 13/62* (2006.01)

(52) U.S. Cl. ..... 439/372; 439/157; 439/76.2

(58) Field of Classification Search ..... 439/76.2, 439/157, 153, 160, 372, 152, 342, 310, 296; 403/321, 322.4; 292/95–96, 100, 200, 304
See application file for complete search history.

(56) References Cited

U.S. PATENT DOCUMENTS 2,430,011 A * 11/1947 Gillentine ..... 439/160
5,035,634 A * 7/1991 Hasircoglu et al. ..... 439/157
6,254,414 B1 * 7/2001 Sawayanagi et al. ..... 439/342
6,500,015 B1 12/2002 Fukamachi et al.
6,739,889 B1 5/2004 Daggett et al.
2003/0124884 A1 * 7/2003 Katsumata et al. ..... 439/76.2
2003/0211764 A1 11/2003 Fukamachi et al.

* cited by examiner

*Primary Examiner*—Tho D. Ta
*Assistant Examiner*—Felix O. Figueroa
(74) *Attorney, Agent, or Firm*—Oliff & Berrdige, PLC

(57) ABSTRACT

To reduce the force required to assemble connectors, a junction box assembly includes a junction box housing holding one or more first connectors, a connector assembly holding one or more second connectors that mate with the one or more first connectors, and first and second cam levers rotatably mounted to the connector assembly. The first and second cam levers rotate in opposite directions about a common axis and engage the junction box housing, and may engage a common point, such as a pin, on the junction box housing. A detent system may be provided to hold the first and second cam levers in a pre-staged position in which open ends of the cam grooves of the first and second cam levers are aligned, and/or in a fully assembled position.

10 Claims, 5 Drawing Sheets

JUNCTION BOX ASSEMBLY WITH CAM LEVERS

BACKGROUND

This invention relates to a junction box assembly, such as an electrical connection box assembly mounted on a vehicle or the like.

In various assembly processes, such as automobile assembly processes, many cable connections must be made, e.g., within the electrical system of a vehicle. Connections are often made using connectors, such as plug-in-type connectors.

SUMMARY

Force multiplying technology has been applied to connectors to reduce the actual force that must be applied by a human operator to connect connectors together. For example, U.S. Pat. No. 6,500,015 and U.S. Patent application Publication No. US 2003/0211764 disclose systems in which rotating levers, also called cams, with cam grooves are provided on a first connector, and a mating corresponding connector is provided with follower pins that interact with the cam grooves. The cams also include a connection pin provided at an end of the cam opposite from an end containing the cam groove. This connection pin interacts with a connection groove provided in a holder that holds the first connector. When the two connectors are pushed together, the cams, follower pins and connection pins provide a force multiplying effect, which reduces the force required to push the connectors together.

However, as systems are designed that require even more conductors per connector, and/or the ganging together of even more connectors for simultaneous assembly to mating connectors, it is desirable to provide systems and methods for further reducing assembly forces, to reduce the occurrence and/or severity of assembly operator fatigue.

Embodiments of this invention address this need by providing a plurality of cam levers that each multiply the manual force applied. A pair of cam levers may act on a common point, resulting in a force multiplying effect double that of a single cam lever acting at that point. A detent system may be provided to hold the cam levers in a pre-staged state and/or to hold the cam levers in place in an assembled state.

These and other objects, advantages and salient features of the invention are described in or apparent from the following description of embodiments.

BRIEF DESCRIPTION OF THE DRAWINGS

Exemplary embodiments will be described with reference to the accompanying drawings, in which like numerals represent like parts, and wherein.

DETAILED DESCRIPTION OF EMBODIMENTS

Embodiments of this invention produce a force-multiplying effect to make it easier for an assembly operator to couple connectors together.

Figure 1:
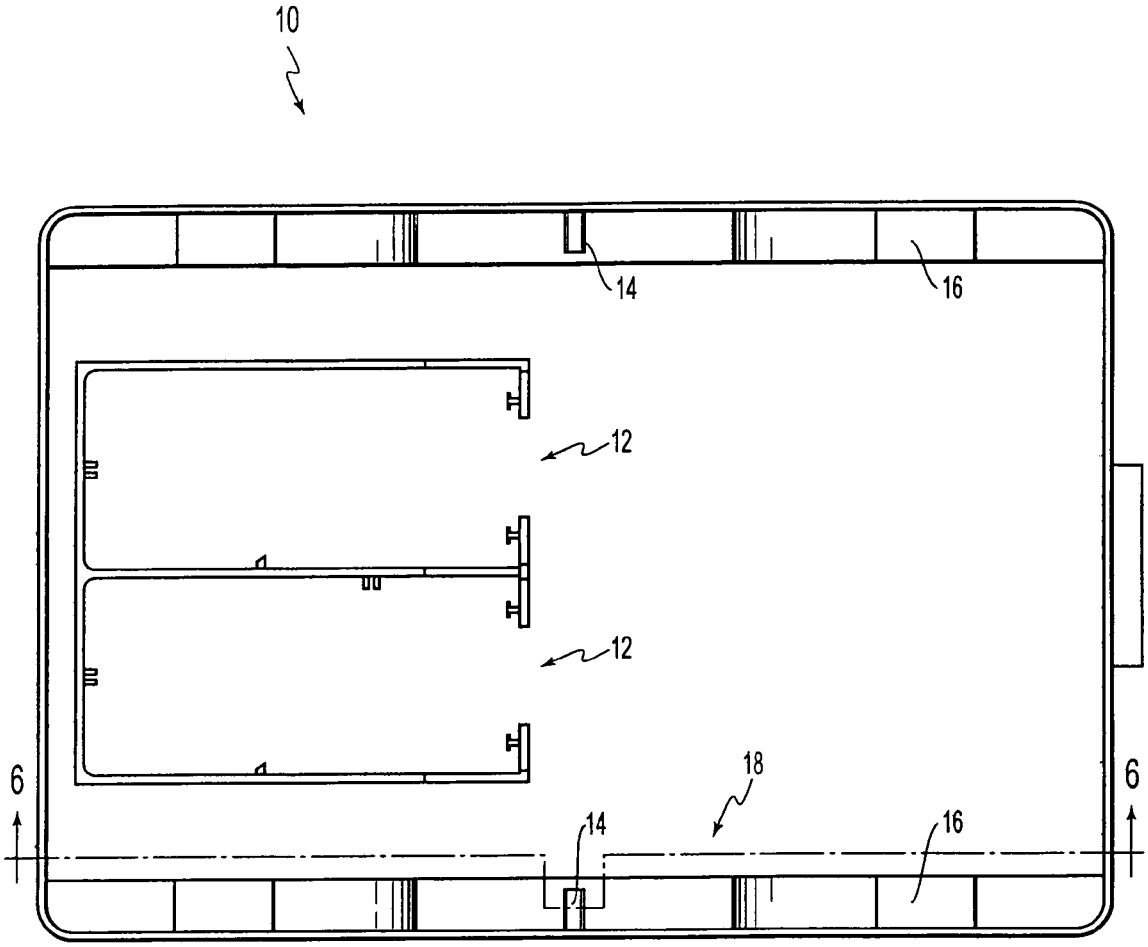
FIG. 1 is a top plan view of a junction box housing.

FIG. 1 shows a top plan view of an exemplary junction box housing 10. Junction box housing 10 includes connector mounting portions 12 into which connectors (shown in FIGS. 4 and 6) may be installed. Holes (not shown) may be provided at any desired location in the junction box housing 10, and cables such as wiring harness cables of an automobile or the like may pass through the openings and be connected to the connectors.

The junction box housing 10 also includes at least one pin 14 projecting from one side wall of the junction box housing 10 toward an opposing side wall, and preferably includes two such pins, projecting from opposing side walls as depicted in FIG. 1.

The junction box housing 10 may include shoulder portions 16 at each corner of the junction box housing 10, and recesses 18 provided surrounding the pins 14.

Figure 2:
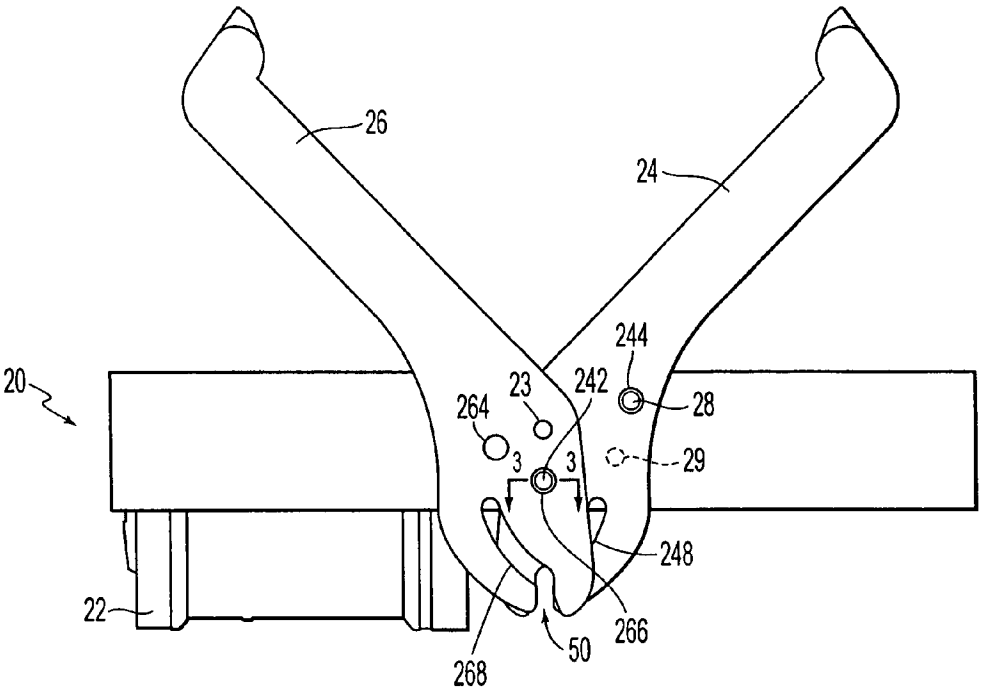
FIG. 2 is an elevation view of a junction box connector assembly, with cam levers in a pre-staged position, that attaches to the junction box housing.

FIG. 2 shows an electrical connector assembly 20 including connectors 22 that mate with connectors provided in the junction box housing 10, as described in detail hereafter. The connector assembly 10 may include relays, fuses and/or other electrical devices (not shown), installed as appropriate to make various desired connections between terminals of the connectors 22.

Cam levers 24 and 26 are rotatably attached to the connector assembly 20 via a rotation shaft 23. The cam lever 26 includes a cam groove 268, and the cam lever 24 includes a cam groove 248. When the cam levers 24 and 26 are in an upward position, open end portions of the cam grooves 248 and 268 align to form an opening 50 through which the pin 14 of the junction box housing 10 may laterally slide.

The levers 24 and 26 are held in the upward position by a detent system. For example, as shown in FIG. 2, the detent system may include a detent recess or through hole 266 that engages a detent protrusion 242 formed on the cam lever 24. In the drawings and the following description, element 266 will be shown as a through hole, and will be referred to as a detent opening, but it will be understood that 266, and other like elements, could also be a recess that does not extend all the way through the cam lever 26 or cam lever 24. It will also be appreciated that the protrusion-and-opening arrangements shown and described may be reversed, e.g., openings may be provided in place of the protrusions and vice versa.

When the detent opening 266 and the detent protrusion 242 are aligned, the detent protrusion 242 projects into the detent opening 266, thereby holding the cam lever 24 in a fixed position relative to the cam lever 26. Additionally, a detent opening 244 formed in the cam lever 24 can be engaged with a detent protrusion 28 formed on the connector assembly 20, thereby holding the cam lever 24 in a predetermined position with respect to the connector assembly 20, as shown in FIG. 2. The position of the cam levers 24 and 26 shown in FIG. 2 is called a pre-staged position, and the cam levers 24 and 26 are held in this pre-staged position by the detent system as described. Of course, other forms of a detent system are possible, and are within the scope of this invention.

The connector assembly 22 may also include a detent protrusion 29. Operation involving the detent protrusion 29 will be described hereafter.

Figure 3:
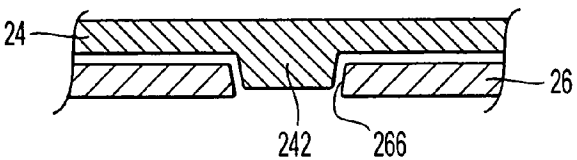
FIG. 3 is a cross-sectional view taken along line 3—3 of FIG. 2.

FIG. 3 shows an exemplary cross section taken along line 3-3 of FIG. 2 through the cam opening 266 and the cam protrusion 242. As depicted, the cam protrusion 244 preferably is beveled to enable it to disengage from the cam opening 264 when a lateral force is applied thereto, e.g., when the cam levers 24 and 26 are pushed downward. Additionally or alternatively, the cam opening 266 may be beveled as depicted. Instead of being beveled, the cam opening 266 and/or cam protrusion 242 may be rounded, or have any other form that causes the direction of force acting between the cam opening 266 and the cam protrusion 242 not to be parallel with the plane of the cam lever 24 or 26. Although cross sections of the other detent mechanisms are not shown, it will be appreciated that they can be formed in the same manner.

Figure 4:
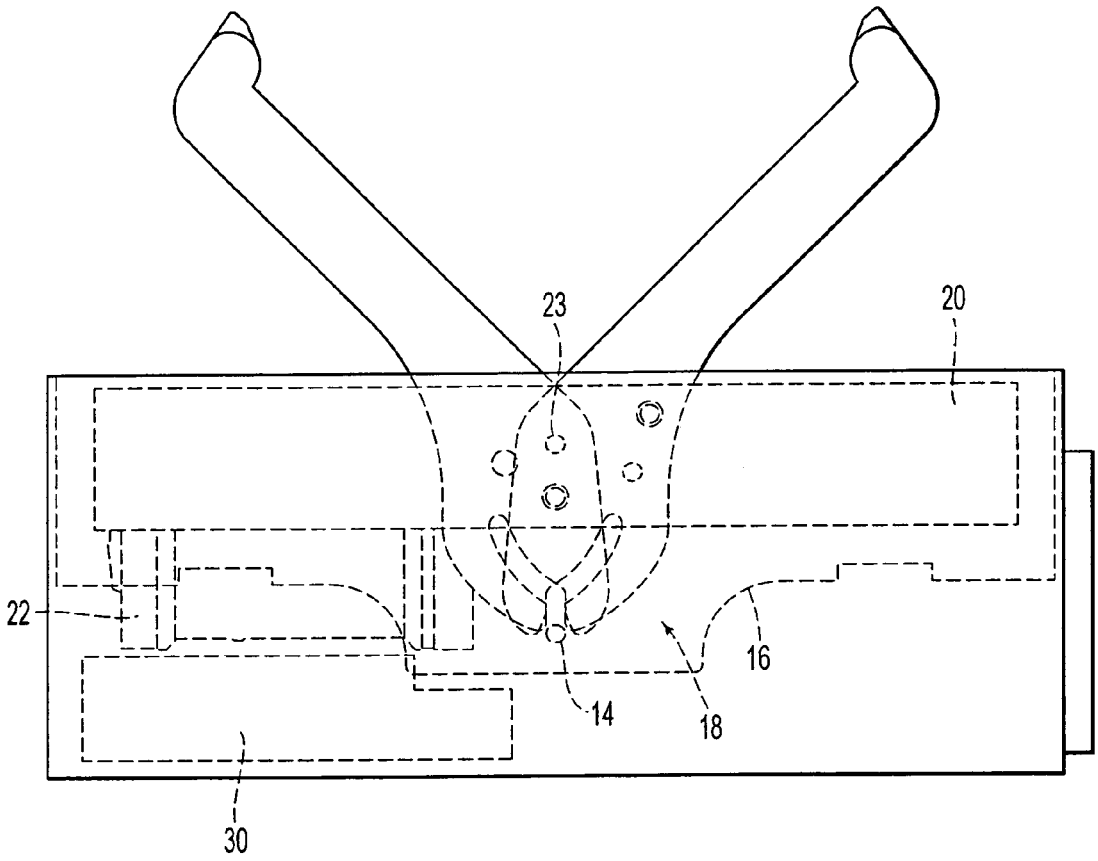
FIG. 4 is an elevation view that illustrates an initial engagement state of the junction box housing and connector assembly.

FIG. 4 shows a state of initial engagement between the connector assembly 20 and the junction box housing 10. As depicted, the pin 14 of the junction box housing 10 enters the opening 50 formed at the aligned open ends of the cam grooves 248 and 268. The connectors 22 and 30 are brought into alignment with each other in this state.

Figure 5:
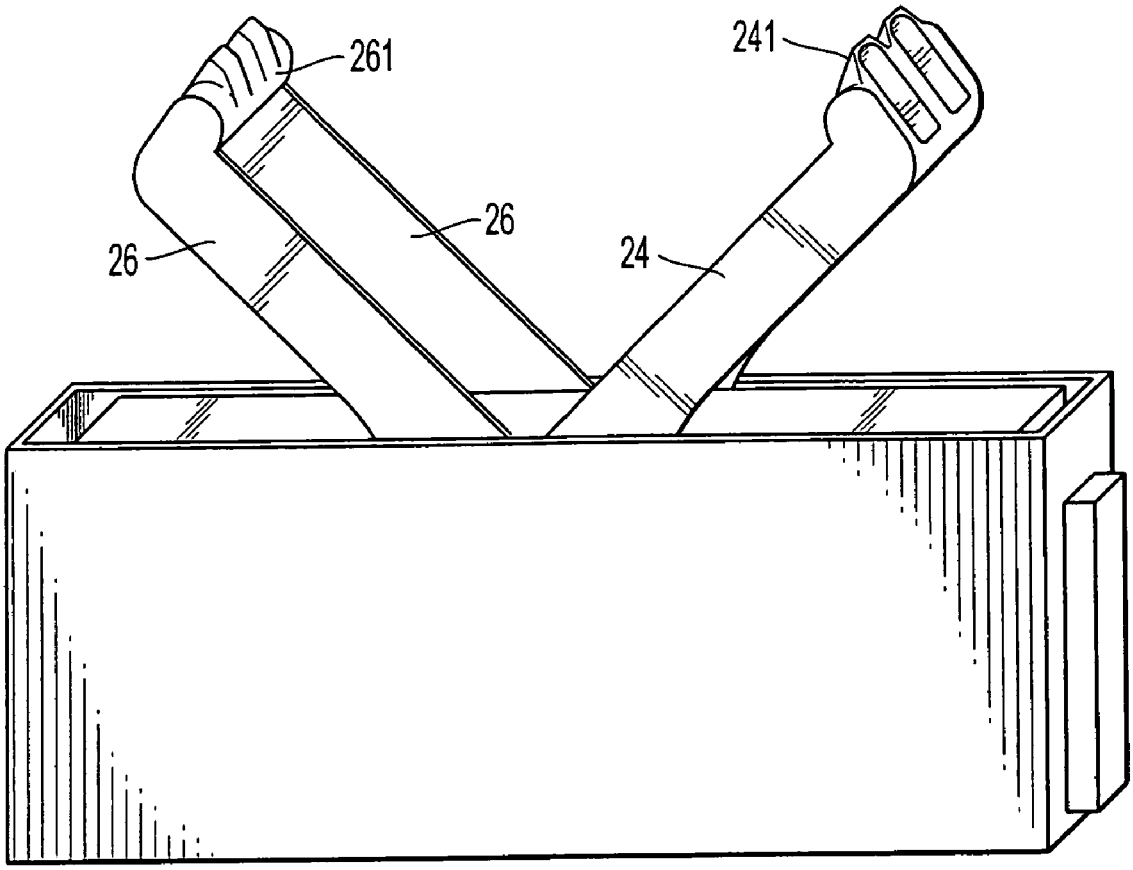
FIG. 5 is a perspective view that illustrates the initial engagement state of the junction box housing and connector assembly of FIG. 4.

FIG. 5 is an oblique view of the junction box housing 10 and the connector assembly 20 in the state of initial engagement shown in FIG. 4, showing that the cam levers 24 and 26 may actually include a pair of cam levers 26 joined by a bar 261, and a pair of cam levers 24 joined by a bar 241.

After being placed in the state of initial engagement shown in FIGS. 4 and 5, the cam levers 24 and 26 are pressed downward, which causes the cam grooves 248 and 268 to act on the pin 14, resulting in the connector assembly 20 between forced downward. During the downward movement, the connector assembly 20 may be guided by the shoulders 16. The recess 18 between the shoulders 16 provides a space that the cam levers 24 and 26 can occupy during the assembly operation and in the fully engaged state.

Figure 6:
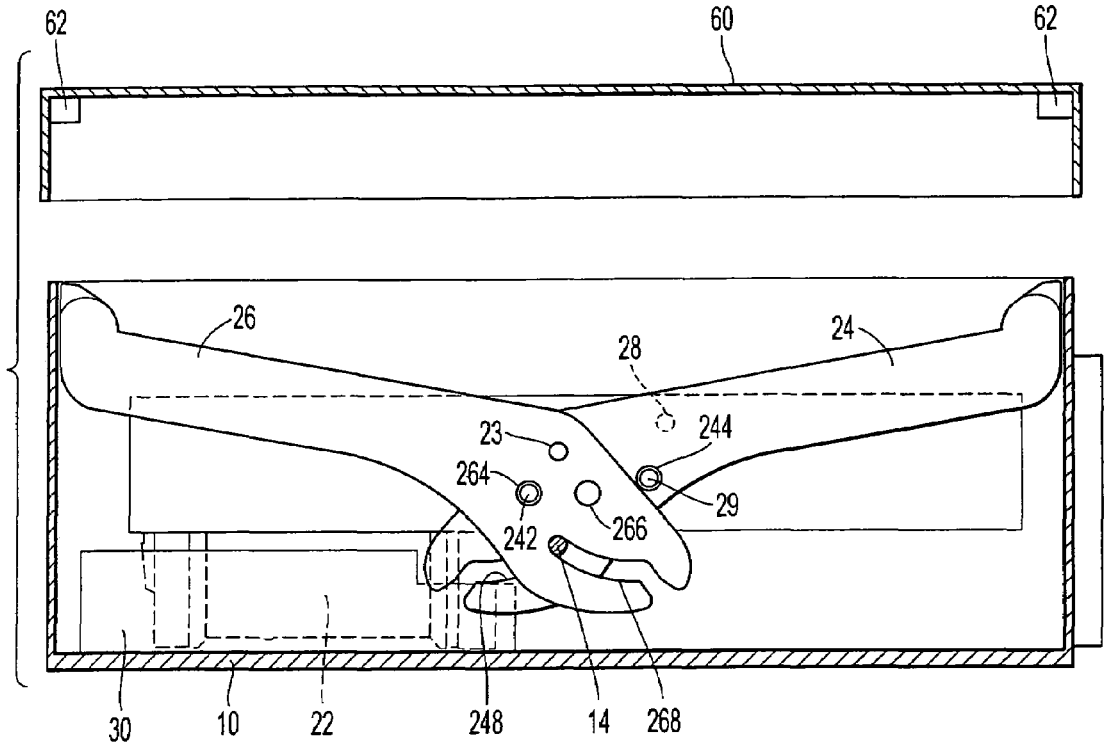
FIG. 6 is a cross-sectional view of the junction box housing of FIG. 1, taken along line 6—6, with the connector assembly of FIG. 2 illustrated in a fully engaged state with respect to the junction box housing.

FIG. 6 shows a cross sectional view of the junction box housing 10, taken along line 6—6 of FIG. 1, with the connector assembly 20 in a fully inserted state. Specifically, the cam levers 24 and 26 have been pushed all the way down, such that the pin 14 is positioned at aligned closed ends of the cam groove 248 and 268. The connectors 22 and 30 are in a fully connected state.

In the position shown in FIG. 6, the above-described detent mechanisms hold the cam levers 24 and 26 in place. Specifically, as shown, cam protrusion 242 of the cam lever 24 is positioned in cam opening 264 of the cam lever 26. Additionally, detent protrusion 29 of the connector assembly 20 may be positioned in detent opening 244 of cam lever 24, thus holding the cam lever 24 with respect to the connector assembly 20.

A cover 60 may then be attached to the open end of the junction box housing 10, and locked by any suitable locking mechanism, such as a snap lock device or the like (not shown). The cover may include tabs 62, which rest against the cam levers 24 and 26 when the cover is locked in place, thereby providing a secondary lock that prevents the cam levers from accidentally lifting upward in a disengaging direction.

While the invention has been described in conjunction with specific embodiments, these embodiments should be viewed as illustrative and not limiting. Various changes, substitutes, improvements or the like are possible within the spirit and scope of the invention.

What is claimed is:

1. A junction box assembly, comprising:

a junction box housing holding one or more first connectors;

a connector assembly holding one or more second connectors that mate with the one or more first connectors; and a plurality of cam levers rotatably mounted to the connector assembly, the plurality of cam levers including a first cam lever and a second cam lever that rotate in opposite directions about a common axis and engage a common point on the junction box housing;

wherein the first cams and the second cams reduce a force necessary to press the connector assembly and the junction box housing into engagement.

2. The junction box assembly of claim 1, wherein the first cam lever and the second cam lever each include a cam groove, and the cam grooves of the first and second cam levers engage a common pin provided on the junction box housing.

3. The junction box assembly of claim 2, further comprising a detent system that holds the first and second cam levers in a pre-staged position in which open ends of the cam grooves of the first and second cam levers are aligned.

4. The junction box assembly of claim 3, further comprising a detent system that holds the first and second cam levers in a fully assembled position.

5. The junction box assembly of claim 1, further comprising a cover that covers an open end of the junction box housing and covers the connector assembly when in the fully assembled state, the cover including a device that restricts the first and second cam levers from moving toward a position of disengagement from the junction box housing.

6. A vehicle in which is mounted the junction box assembly of claim 1.

7. A junction box assembly, comprising:

a junction box housing holding one or more first connectors;

a connector assembly holding one or more second connectors that mate with the one or more first connectors;

a plurality of cam levers rotatably mounted to the connector assembly, the plurality of cam levers including a first cam lever and a second cam lever that rotate in opposite directions about a common axis and engage the junction box housing; and a detent system that holds the first and second cam levers in a pre-staged position in which open ends of the cam grooves of the first and second cam levers are aligned;

wherein the first cams and the second cams reduce a force necessary to press the connector assembly and the junction box housing into engagement.

8. The junction box assembly of claim 7, further comprising a detent system that holds the first and second cam levers in a fully assembled position.

9. The junction box assembly of claim 7, further comprising a cover that covers an open end of the junction box housing and covers the connector assembly when in the fully assembled state, the cover including a device that restricts the first and second cam levers from moving toward a position of disengagement from the junction box housing.

10. A vehicle in which is mounted the junction box assembly of claim 7.

* * * * *